United States Patent [19]

Walker

[11] Patent Number: 4,698,865

[45] Date of Patent: Oct. 13, 1987

[54] CONTOUR BED SHEET

[76] Inventor: Robert G. Walker, 111 Colonial Dr., Vicksburg, Miss. 39180

[21] Appl. No.: 728,321

[22] Filed: Apr. 29, 1985

[51] Int. Cl.[4] ..... A47G 9/02

[52] U.S. Cl. ..... 5/497; 5/495

[58] Field of Search ..... 5/497, 495, 485, 482

[56] References Cited

U.S. PATENT DOCUMENTS

| | | | |
|---|---|---|---|
| 2,151,375 | 3/1939 | De Voe | 5/497 |
| 2,454,463 | 11/1948 | Kromer et al. | 5/497 |
| 2,569,627 | 10/1951 | Black | 5/497 |
| 2,679,056 | 5/1954 | Simpson | 5/485 |
| 2,695,414 | 11/1954 | Ford et al. | 5/485 |
| 3,060,462 | 10/1962 | Miller | 5/485 |
| 3,694,832 | 10/1972 | Jamison | 5/497 |
| 3,868,735 | 3/1975 | Ross | 5/497 |
| 4,245,365 | 1/1981 | Large | 5/497 |

*Primary Examiner*—Alexander Grosz

[57] ABSTRACT

In accordance with the present invention, a contour bed sheet is provided in which the contour is formed integral with the sheet. The sheet is formed by cutting slots in the edges of each end of the bottom sheet and at one end of a top sheet. The slots are cut at selected locations of the edges of the sheet such that when the cut edges are sewn or otherwise joined together, that a mattress end flap and bottom flap are formed to define a contour sheet.

5 Claims, 4 Drawing Figures

CONTOUR BED SHEET

BACKGROUND OF THE INVENTION

Previously contoured sheets have been formed by providing elastic in the ends of the sheets. The elastic is located in a folded and sewn end portion at each end of bottom sheets, and at the foot end of top sheets.

However, the elastic in such sheets stretches with time and becomes less efficient in maintaining the sheet in place.

Furthermore, in hospitals and nursing homes, when the patient is raised up in the bed, frequently the elastic is not effective to hold the sheet in place, particularly after sufficient use has occurred to significantly stretch the elastic sheet.

SUMMARY OF THE INVENTION

A. Objects

One object of the invention is to provide a contour sheet in which the contour is formed as an integral part of the sheet, instead of from elastic material which tends to lose its effectiveness over time.

Another object of the invention is to provide a contoured bedding sheet which tends to remain in place even when the bed is raised and lowered frequently, for example in hospitals and nursing homes.

Another object of the invention is to provide a contour sheet wherein the sheet tends to remain in place even when significant tossing and turning occurs in the bed.

B. Summary

In accordance with the present invention, a contour bed sheet is provided in which the contour is formed integral with the sheet. The sheet is formed by cutting slots in the edges of each end of the bottom sheet and at one end of a top sheet. The slots are cut at selected locations of the edge of the sheet such that when the cut edges are sewn of otherwise joined together, that a mattress end flap and bottom flap are formed to define a contour sheet.

THE DRAWINGS

DESCRIPTION OF PREFERRED EMBODIMENTS

Figure 1:
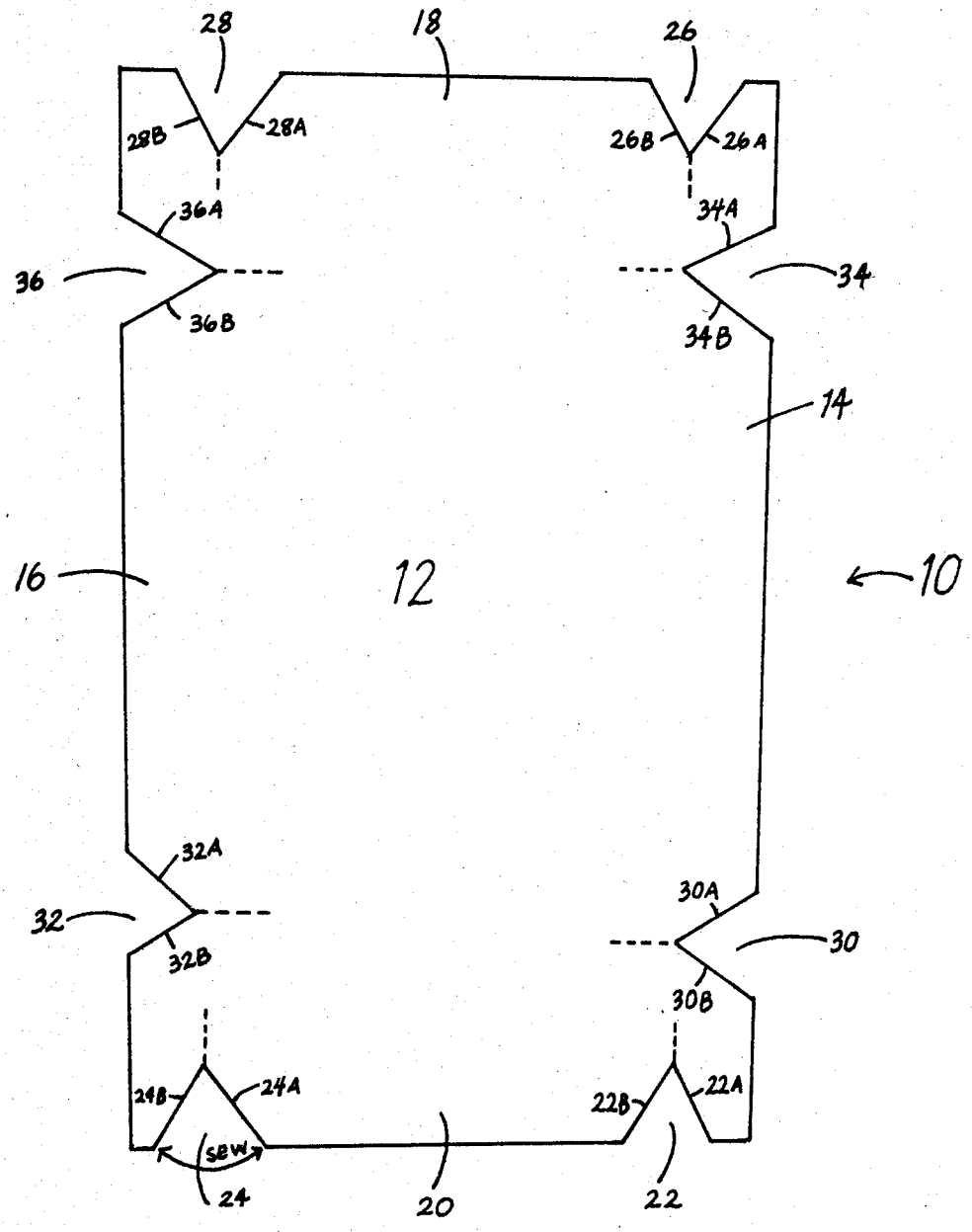
FIG. 1 is a plan view of one embodiment of the present invention illustrating the cut slots.

In accordance with one embodiment of the invention, in FIG. 1, a contour sheet is indicated generally at 10. The sheet includes a body portion 12. The sheet is generally rectangular in shape, although the shape is not critical to the invention, and includes side portions 14 and 16, and end portions 18 and 20. The length and width, or diameter for a circular sheet, as the case may be, are selected to be commensurate with the size of the particular mattress to be used with the sheet. Sufficient additional material is provided to include end flaps and side flaps to be discussed further hereinafter.

To form the contour, a series of slots, 22, 24, 26, and 28, are formed in the respective end portions of the sheet. In addition, slots 30, 32, 34, and 36, are formed in the side portions 14, and 16.

The slots are preferably triangular in shape to facilitate sewing the adjacent edges together. The contour is formed by stitching and/or sewing, or otherwise attaching the respective edges together ie., 22A to 22B, 24A to 24B, 26A to 26B, 28A to 28B, 30A to 30B, 32A to 32B, 36A to 36B.

Figure 2:
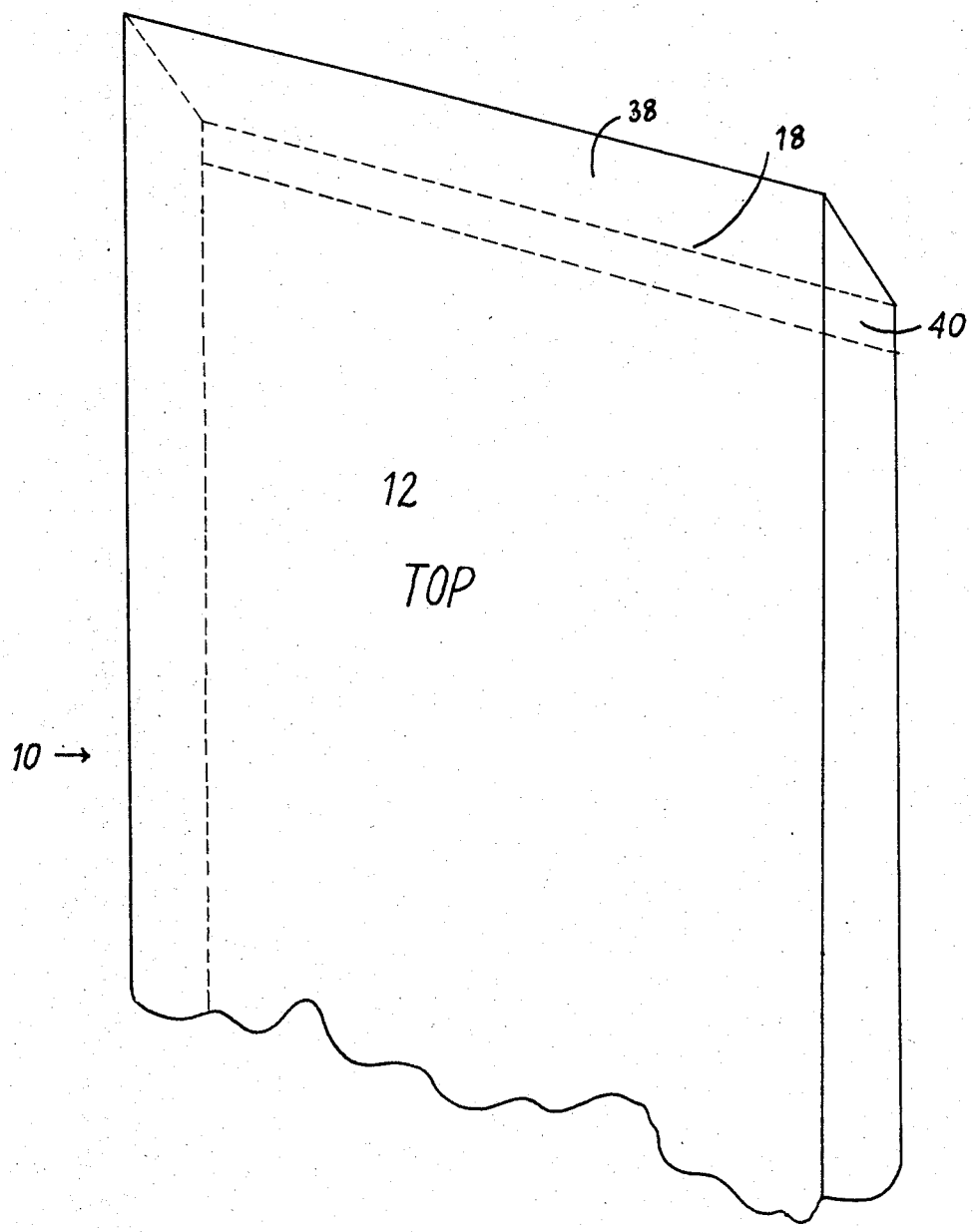
FIG. 2 is a perspective view of the embodiment illustrating end vertical and horizontal flaps formed according to the present invention.

As shown in FIG. 2, this forms an end vertical flap 38, and an end bottom horizontal flap 40 shown dotted in FIG. 2. A similar pair of end flaps is be formed at end portion 20.

Figure 3:
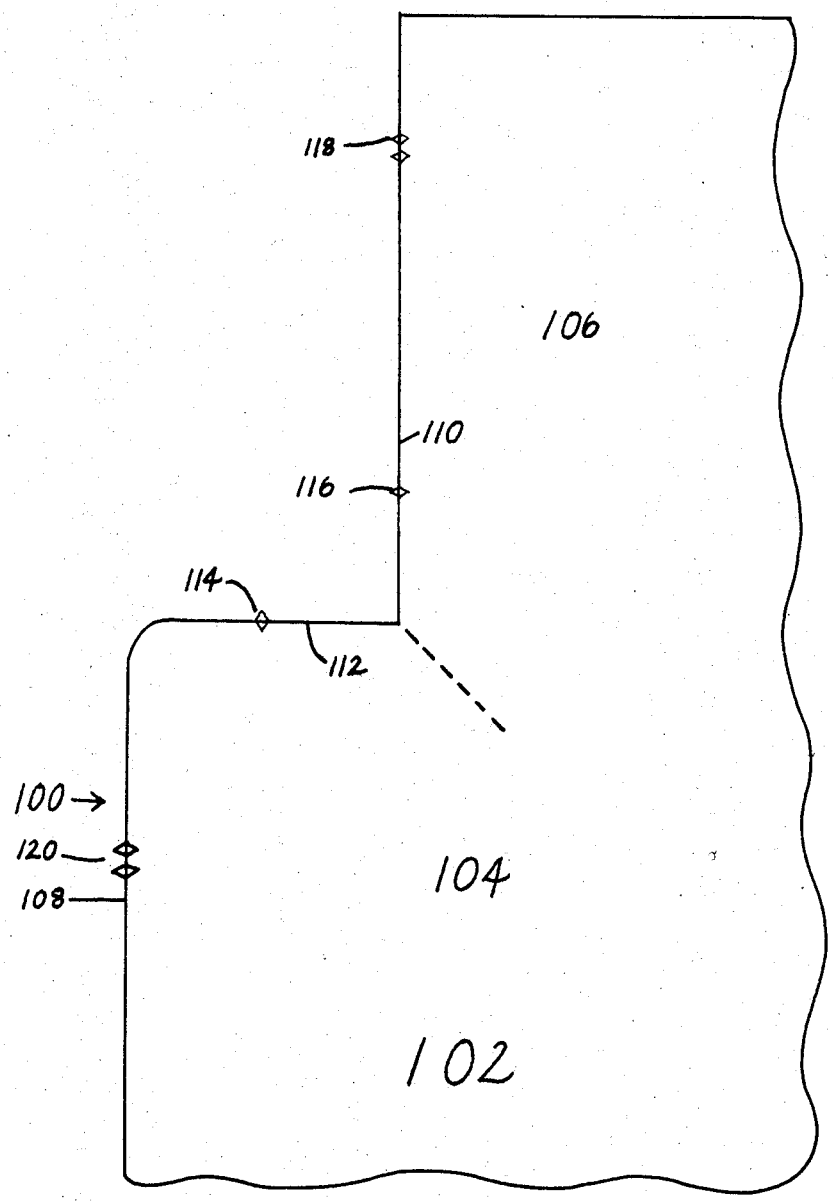
FIG. 3 is a plan view of another embodiment of the present invention.

In FIG. 3 another embodimenet of the present invention is illustrated at 100. In this embodiment a sheet 102 includes a body portion 104. Cuts are made in a corner portion 106.

Specifically at the corner 106 a first cut 110 is provided parallel to an edge 108 of a distance from 2 to 15 inches.

A second cut 112 is provided in a direction perpendicular to the cut 110 from the edge 108 inwardly. The length of the cut 112 is substantially less than the length of the cut 110. Preferably the cut 112 is $\frac{1}{4}$ to $\frac{1}{3}$ of the length of the cut 110.

In order to achieve a rounded end portion, the surfaces 110 and 112 are sewn together as indicated by the parallel lines 114 and 116. After these portions have been sewn together, the surfaces 118 and 120 are sewn together which defines the necessary end corners.

Figure 4:
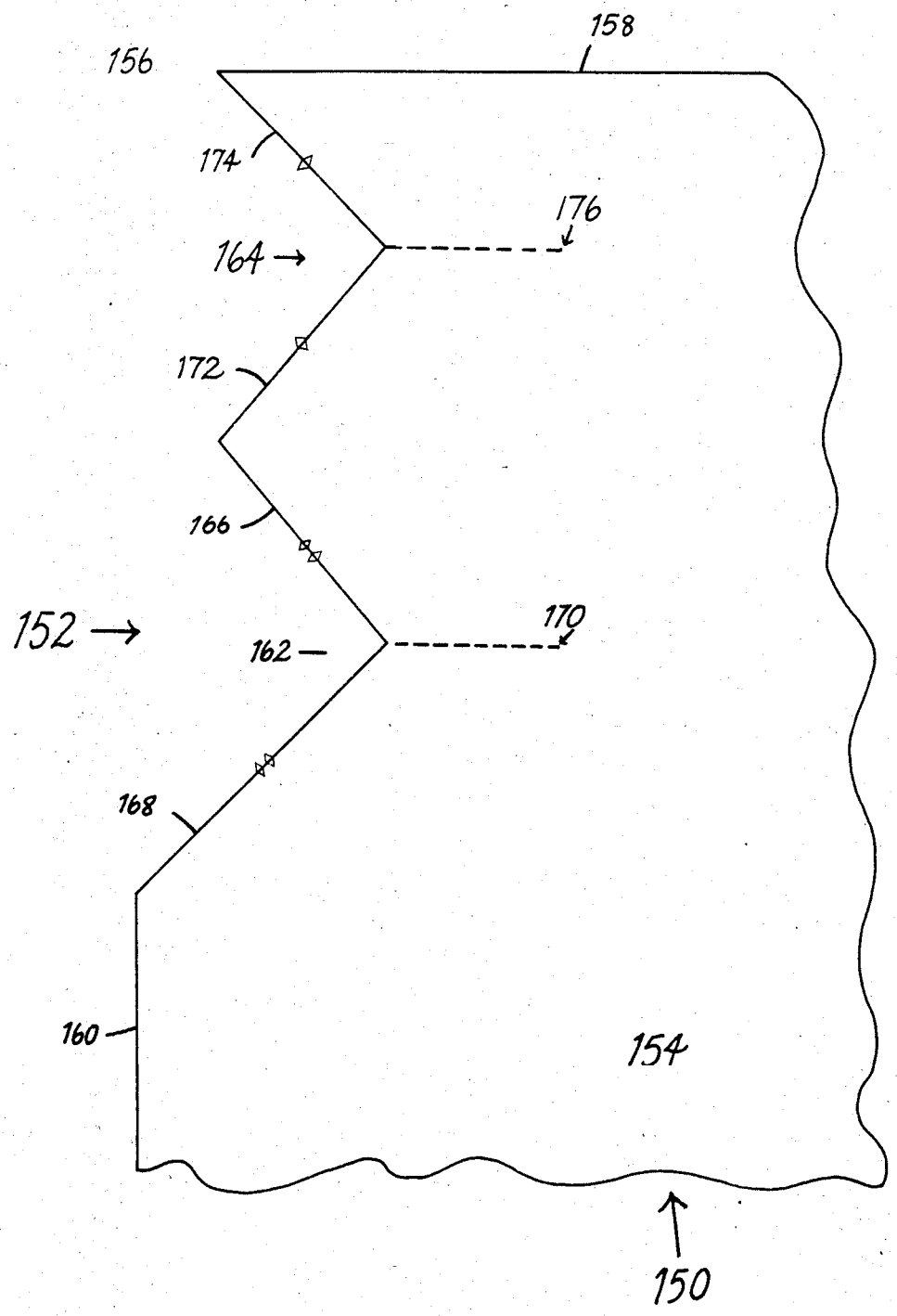
FIG. 4 is a plan view for another embodiment of the present invention.

In still another embodiment indicated in FIG. 4 of the drawings generally at 150, a sheet 152 includes a body portion 154 having a corner 156 and a first edge 158 and a second edge 160. A pair of cuts 162 and 164 are made in the edge 160. These cuts are generally triangular in shape and an angle of at least 30 degrees is utilized for these cuts. The depth of the cuts is usually conveniently from 2 to 10 inches.

The cut 162 results in cut surfaces 166 and 168. These surfaces are folded on the imaginary line 170 and are sewn together.

Simularly, the cut 164 defines cut surfaces 172 and 174. These surfaces are folded along the imaginary line 176 and are sewn together.

As a result end corners are formed which will remain in place in engagement with a mattress of appropriate size longer generally than a corner having elastic to hold the sheet in place because the formed corners of the present invention do not deteriorate with time.

Furthermore, when beds having the formed contour sheets are lifted to enable a person or patient to sit erect, the sheets remain in place to a significantly greater extent than sheets using elastic to hold the sheets in place.

What is claimed is:

1. A contour sheet comprising:

a sheet body portion made of flexible sheet material which is generally rectangular in shape;

a pair of adjacent, generally triangular slots formed in a single side, along opposite edges of said body portion, of a configuration such that joinder of adjacent edges defined by said slots form one continuous end flap and one continuous bottom flap; and means for joining together said adjacent edges to form said end flap and said bottom flap, whereby said end flap and said bottom flap are adapted to hold said sheet body portion in place and in engagement with a suitably sized mattress.

2. A contour sheet according to claim 1 wherein end flaps and bottom flaps are formed at both end portions of said sheet body portion.

3. A contour sheet according to claim 1 wherein the means for joining together edges comprises sewn thread.

4. A contour sheet according to claim 1 wherein said means for joining said edges comprises stitches.

5. A contour sheet according to claim 1, wherein only one end portion of said sheet is provided with an end flap and a bottom flap to form a top sheet.

* * * * *